US009266138B1

(12) United States Patent
Massaro

(10) Patent No.: US 9,266,138 B1
(45) Date of Patent: Feb. 23, 2016

(54) FREE STANDING HOSE STAND

(71) Applicant: Joseph A. Massaro, Smithtown, NY (US)

(72) Inventor: Joseph A. Massaro, Smithtown, NY (US)

( * ) Notice: Subject to any disclaimer, the term of this patent is extended or adjusted under 35 U.S.C. 154(b) by 158 days.

(21) Appl. No.: 14/087,943

(22) Filed: Nov. 22, 2013

(51) Int. Cl.
*A47G 29/00* (2006.01)
*B05B 15/06* (2006.01)

(52) U.S. Cl.
CPC ..... *B05B 15/061* (2013.01)

(58) Field of Classification Search
CPC ..... B05B 15/063
USPC ..... 248/528, 529, 75, 80, 81, 83, 163.1, 248/165, 166, 170, 171, 177.1, 188.1, 248/188.6, 188.7, 188.8, 188.9, 122.1
See application file for complete search history.

(56) References Cited

U.S. PATENT DOCUMENTS

| | | | | |
|---|---|---|---|---|
| 731,172 | A | 6/1903 | Garvey | |
| 807,184 | A | 12/1905 | Malnburg | |
| 836,864 | A | 11/1906 | Cole | |
| 1,674,493 | A | 6/1928 | Adams | |
| 2,309,772 | A | 2/1943 | Karger | |
| 2,694,600 | A | 11/1954 | Richey | |
| 2,763,453 | A * | 9/1956 | Palino | 248/514 |
| 2,792,257 | A * | 5/1957 | Davis | 239/276 |
| 3,334,852 | A | 8/1967 | Sumida et al. | |
| 3,386,754 | A | 6/1968 | Morrison | |
| 4,521,036 | A | 6/1985 | Howell, Jr. et al. | |
| 4,801,239 | A * | 1/1989 | Austad | 414/680 |
| 5,452,872 | A * | 9/1995 | Barnes et al. | 248/85 |
| 5,507,384 | A * | 4/1996 | Maeng | 206/315.7 |
| 5,836,516 | A * | 11/1998 | Van Epps et al. | 239/280.5 |
| 6,209,829 | B1 * | 4/2001 | Yu | 248/122.1 |
| 6,322,027 | B1 * | 11/2001 | Hsu | 248/177.1 |
| 7,717,378 | B2 * | 5/2010 | Yu | 248/166 |
| 8,490,942 | B1 * | 7/2013 | Henry | 248/441.1 |
| 2002/0070319 | A1 * | 6/2002 | Yu | 248/122.1 |
| 2005/0023429 | A1 * | 2/2005 | Gardner | 248/530 |
| 2012/0286075 | A1 | 11/2012 | Brueske | |

* cited by examiner

*Primary Examiner* — Terrell McKinnon
*Assistant Examiner* — Michael McDuffie
(74) *Attorney, Agent, or Firm* — Richard L Miller

(57) ABSTRACT

A free-standing stand that holds a hose and that automatically erects upon contact with a supporting surface and automatically collapses when removed from contact with the supporting surface. The free-standing stand includes a spine and a tripod. The spine has the hose be replaceably held thereto. The tripod is operatively connected to the spine in such a matter that when the tripod contacts the supporting surface the tripod automatically erects and when the tripod is removed from contact with the supporting surface the tripod automatically collapses.

73 Claims, 11 Drawing Sheets

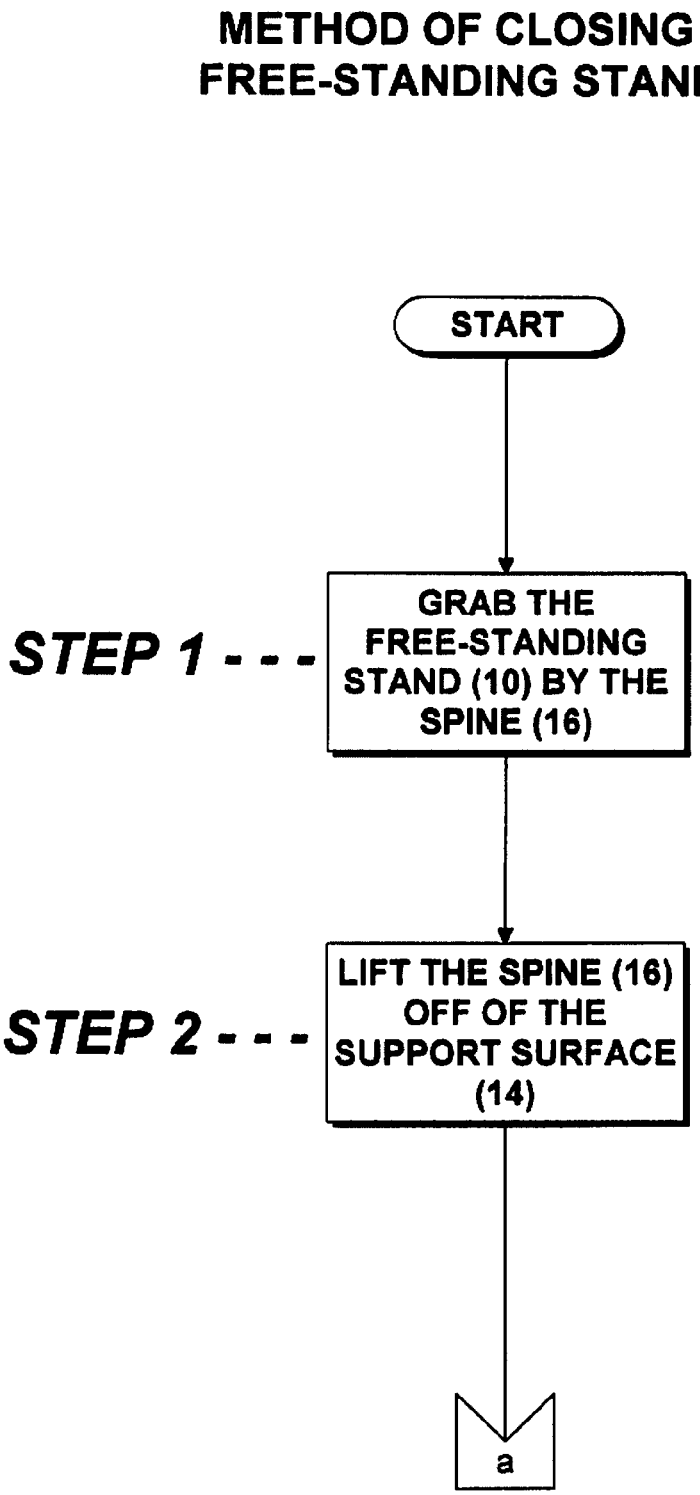
Fig. 10-A

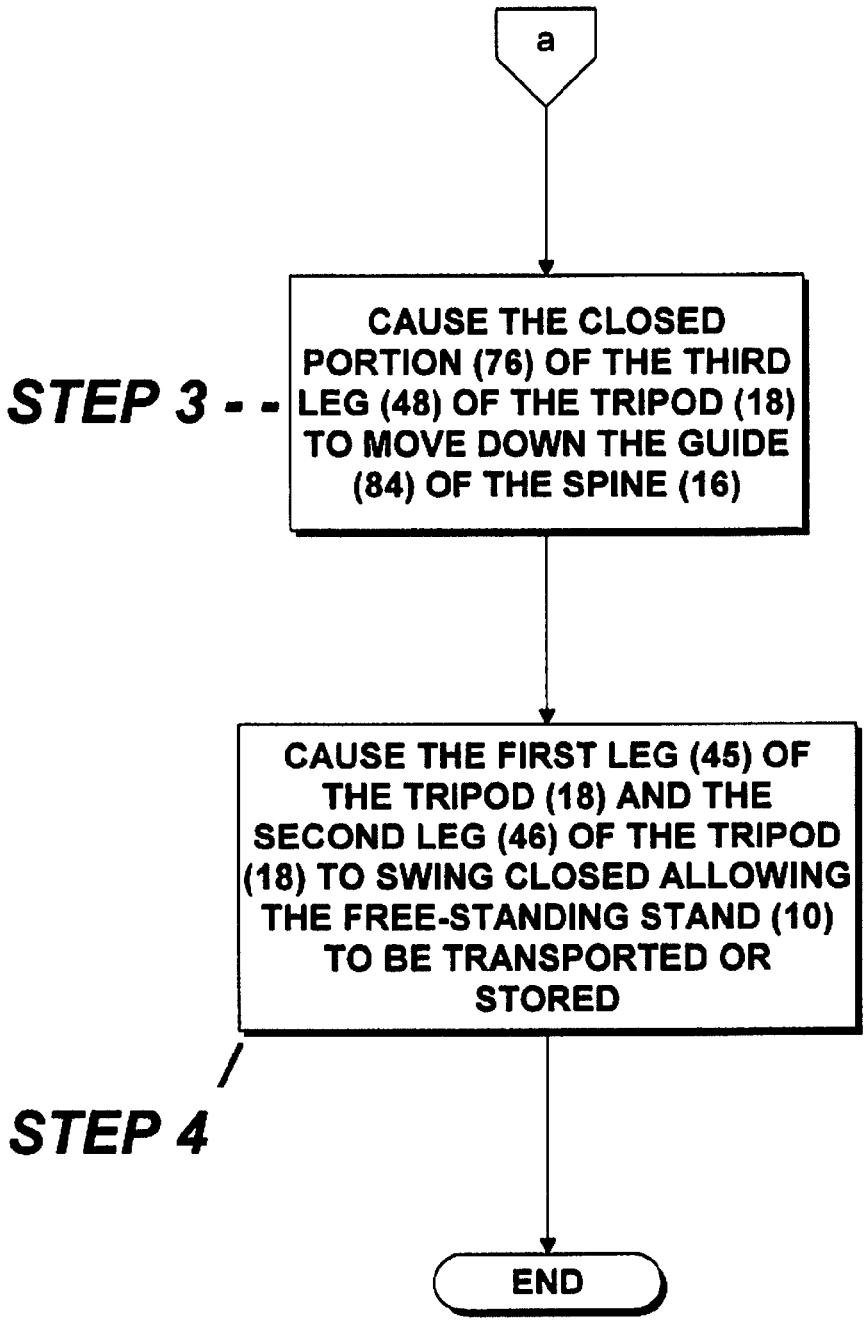
Fig. 10-B

FREE STANDING HOSE STAND

BACKGROUND OF THE INVENTION

1. Field of the Invention

The present invention relates to a hose stand, and more particularly, a free standing hose stand.

2. Description of the Prior Art

Numerous innovations for hose supports and related apparatus have been provided in the prior art that will be described. Even though these innovations may be suitable for the specific individual purposes to which they address, however, they differ from the present invention.

A FIRST EXAMPLE, U.S. Pat. No. 731,172, Issued on Jun. 16, 1903, to Garvey teaches a hose-holder including a standard, a reel, and a clamp pivoted to swing vertically and horizontally and provided with a hinged handle and a spring.

A SECOND EXAMPLE, U.S. Pat. No. 807,184, Issued on Dec. 12, 1905, to Malnburg teaches a hose-support including a folding tripod, one leg thereof being tubular, a hose-coupling on the tubular leg, a short curved pipe having a rotary connection with the upper end of the tubular leg, a flexible nozzle-carrying pipe extended from the short pipe, arms pivoted to opposite sides of the short pipe and has portions extended along opposite sides of the flexible pipe and provided with outwardly extended handle members, and a collar on the flexible pipe with which the arms engage.

A THIRD EXAMPLE, U.S. Pat. No. 836,864, Issued on Nov. 27, 1906, to Cole teaches a device including a standard having a head provided with legs, an anchor connected with one of the legs, a frame having a stud rotatably arranged in the head, apparatus for clamping the stud to the head, a shaft rotatably arranged in the free ends of the frame, and a clamp having extensions engaging the shaft. The clamp is adapted to removably support the nozzle of a fire-hose. A worm-wheel is carried by the shaft, and a housing forms the extension of the frame and surrounds the worm wheel and has a worm-shaft engaging the worm-wheel. The worm-shaft is adapted when actuated to rotate the worm gear and when released prevents rotation of the same, the shaft, and clamp.

A FOURTH EXAMPLE, U.S. Pat. No. 1,674,493, Issued on Jun. 19, 1928, to Adams teaches a hose stand including a tripod having a plurality of legs. The upper ends of the legs have eyes carried thereby. A ring is pivotally engaged in the eyes, a hook is supported by the ring, a hose carrier has a hanger for detachably engaging the hook, hooks are carried by the carrier for detachably engaging a hose, a hose, and clamps carried by the carrier for detachably engaging the nozzle of a hose.

A FIFTH EXAMPLE, U.S. Pat. No. 2,309,772, Issued on Feb. 2, 1943, to Karger teaches a garden hose stand including a standard having a flat a perforated part with cam surfaces, locking apparatus fixed to the part, clamp members for fitting at opposite sides of the flat part and so related to the flat part that the lower edges of the members are fulcrumed on the cam surfaces, and a screw fixed on one member and passing through the perforated part and through the companion member. The companion member has an intermediate segment part with spaced perforations for selectively engaging the locking apparatus, and a nut is threaded on the screw.

A SIXTH EXAMPLE, U.S. Pat. No. 2,694,600, Issued on Nov. 16, 1954, to Richey teaches a stand for supporting a lawn sprinkler in an elevated position, which includes circular C-shaped base having a bar extending across the same, parallel to a chord connecting the ends of the base and between the chord and the center of the base, and a pipe having its lower end provided with an angle pipe coupling for effecting connection with a water carrying hose. The pipe and coupling is supported by the bar. The pipe projects upwardly from the center of the base in a direction substantially perpendicular to the plane of the base. At least three braces have their lower ends welded to the base at angularly spaced points and their upper ends are connected with the pipe serving to hold the pipe in a predetermined vertical position with respect to the plane of the base, wheel supporting brackets are attached to the ends of the base and project upwardly therefrom, and wheels are carried by the brackets for rotation about a common axis. The axis of rotation is positioned above the plane of the lower surface of the base a distance at least as great as the radius of the wheels whereby the base may rest with its entire undersurface in contact with a plane supporting surface.

A SEVENTH EXAMPLE, U.S. Pat. No. 3,334,852, Issued on Aug. 8, 1967, to Sumida, et al. teaches a device to engage and hold a portion of a hose, which includes a yoke to engage the portion of the hose, and a base structure supporting the yoke. The yoke has two spaced projections extending therefrom in the same lateral direction with surfaces to engage the one side of the portion of the hose. The yoke further has a third projection extending in the same lateral direction with a surface to engage the other side of the portion of the hose. The third projection is between the first two projections with the surface of the third projection spaced from a line defined by the surfaces of the two projections. The surface of the third projection is spaced from the line by less than the outside diameter of the hose to cause the portion of the hose to bow with the hose resiliently opposing the bowing.

AN EIGHTH EXAMPLE, U.S. Pat. No. 3,386,754, Issued on Jun. 4, 1968, to Morrison teaches a hose coupling support and disconnect mechanism for housing couplings having male and female coupling halves retained coupled by displaceable balls engaged with the male half by a spring-biased sleeve for reciprocation of the female half. The mechanism includes a clamp for engaging the sleeve so that overload pull on the hose connected with the male half will separate the coupling. The coupling is supported on a vertical pivot to permit the coupling to swing as required and a lever is mounted on a horizontal pivot extending transversely of the coupling to engage the female half and displace it relative to the sleeve to facilitate uncoupling the male half. The lever is provided with a bifurcated coupling-engaging portion and an operating portion extending above the coupling sleeve at an acute angle to the axis of the coupling female half.

A NINTH EXAMPLE, U.S. Pat. No. 4,521,036, issued on Jun. 4, 1985, to Howell, Jr., et al. teaches a knock-down support structure for a lawn sprinkler head, which includes a standpipe whose upper end is connected to the sprinkler head and whose lower end is connected to a garden hose, and a tripod stand supporting the standpipe. The stand includes separable legs secured by fasteners that also engage supporting brackets on the standpipe.

A TENTH EXAMPLE, U.S. Patent Office Document No. 2012/0286075, Published on Nov. 15, 2012, to Brueske teaches a telescoping tripod sprinkler cart including a tripod junction unit, a plurality of support members, a sprinkler support assembly, and a telescoping assembly. In some preferred embodiments, the telescoping tripod sprinkler cart also includes a carriage assembly to enable the portability of the telescoping tripod sprinkler cart.

It is apparent now that numerous innovations for hose supports and related apparatus have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a free standing hose stand that avoids the disadvantages of the prior art.

ANOTHER OBJECT of the present invention is to provide a free standing hose stand that is simple and inexpensive to manufacture.

STILL ANOTHER OBJECT of the present invention is to provide a free standing hose stand that is simple to use.

BRIEFLY STATED, STILL YET ANOTHER OBJECT of the present invention is to provide a free-standing stand that holds a hose and that automatically erects upon contact with a supporting surface and automatically collapses when removed from contact with the supporting surface. The free-standing stand includes a spine and a tripod. The spine has the hose be replaceably held thereto. The tripod is operatively connected to the spine in such a matter that when the tripod contacts the supporting surface the tripod automatically erects and when the tripod is removed from contact with the supporting surface the tripod automatically collapses.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIGS. 10A-10B are a flowchart of the method of collapsing the free-standing stand.

A MARSHALING OF REFERENCE NUMERALS UTILIZED IN THE DRAWING

Figure 1:
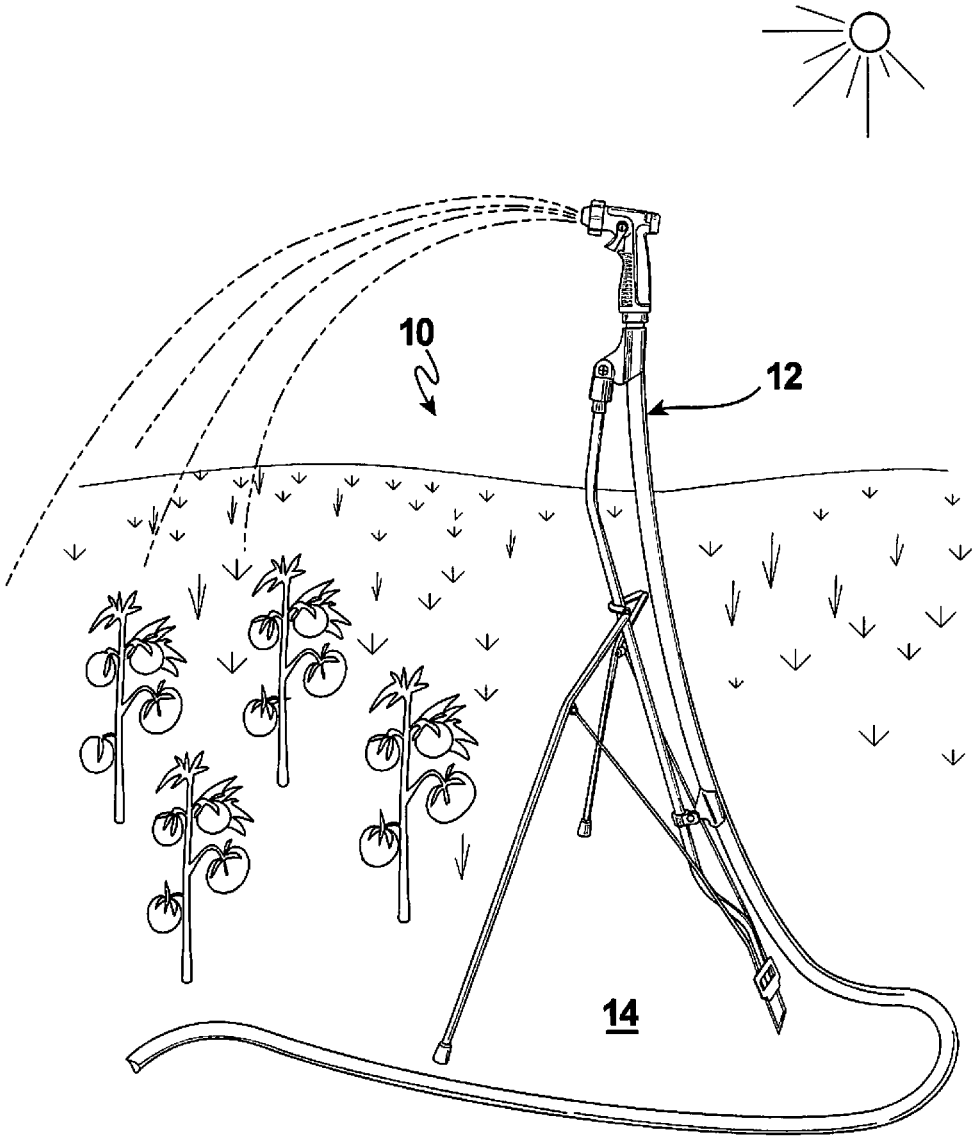
FIG. 1 is a perspective illustrating the free standing hose stand being utilized to water plants while free standing on the ground.

10 free-standing stand of embodiments of present invention for replaceably holding hose 12 and for automatically erecting upon contact with supporting surface 14 and automatically collapsing when removed from contact with supporting surface 14
12 hose
14 supporting surface
16 spine for having hose 12 be replaceably held thereto
18 tripod
20 first portion of spine 16
22 imaginary upper end of first portion 20 of spine 16
24 imaginary lower end of first portion 20 of spine 16
26 second portion of spine 16
28 upper terminal end of second portion 26 of spine 16
30 third portion of spine 16
32 imaginary lower end of third portion 30 of spine 16
34 fourth portion of spine 16
36 imaginary lower end of fourth portion 34 of spine 16
38 fifth portion of spine 16
40 lower terminal end of fifth portion 38 of spine 16
42 pair of ribs of spine 16
44 pair of terminal ends of pair of ribs 42 of spine 16, respectively
45 first leg of tripod 18
46 second leg of tripod 18
48 third leg of tripod 18
50 first portion of first leg 45 of tripod 18
52 imaginary lower end of first portion 50 of first leg 45 of tripod 18
54 second portion of first leg 45 of tripod 18
56 end of second portion 54 of first leg 45 of tripod 18
58 eyelet of first leg 45 of tripod 18
60 rubber foot of first leg 45 of tripod 18
62 first portion of second leg 46 of tripod 18
64 imaginary lower end of first portion 62 of second leg 46 of tripod 18
66 second portion of second leg 46 of tripod 18
68 end of second portion 66 of second leg 46 of tripod 18
70 eyelet of second leg 46 of tripod 18
72 rubber foot of second leg 46 of tripod 18
74 pair of free ends of third leg 48 of tripod 18
76 closed portion of third leg 48 of tripod 18
78 pair of appropriate fasteners of third leg 48 of tripod 18
82 lower end of spine 16
84 guide of spine 16
86 360° adjustable head
88 upper hose holder clip for replaceably holding working end of hose 12
90 lower hose holder clip for replaceably holding another portion of hose 12

DETAILED DESCRIPTION OF THE PREFERRED EMBODIMENT

Figure 2:
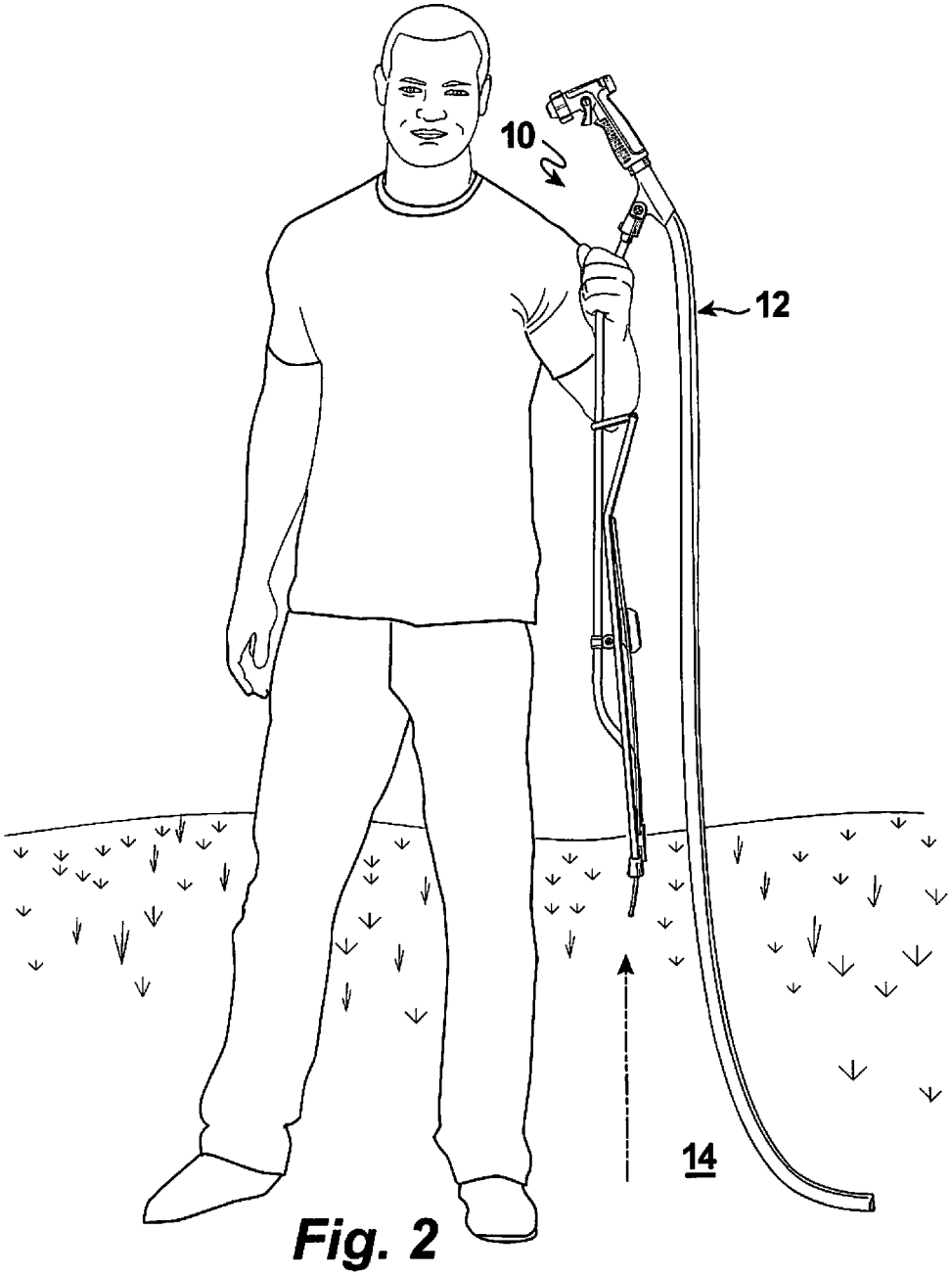
FIG. 2 is a illustrates a user placing/removing the free standing hose stand for/from watering a lawn area.
Figure 3:
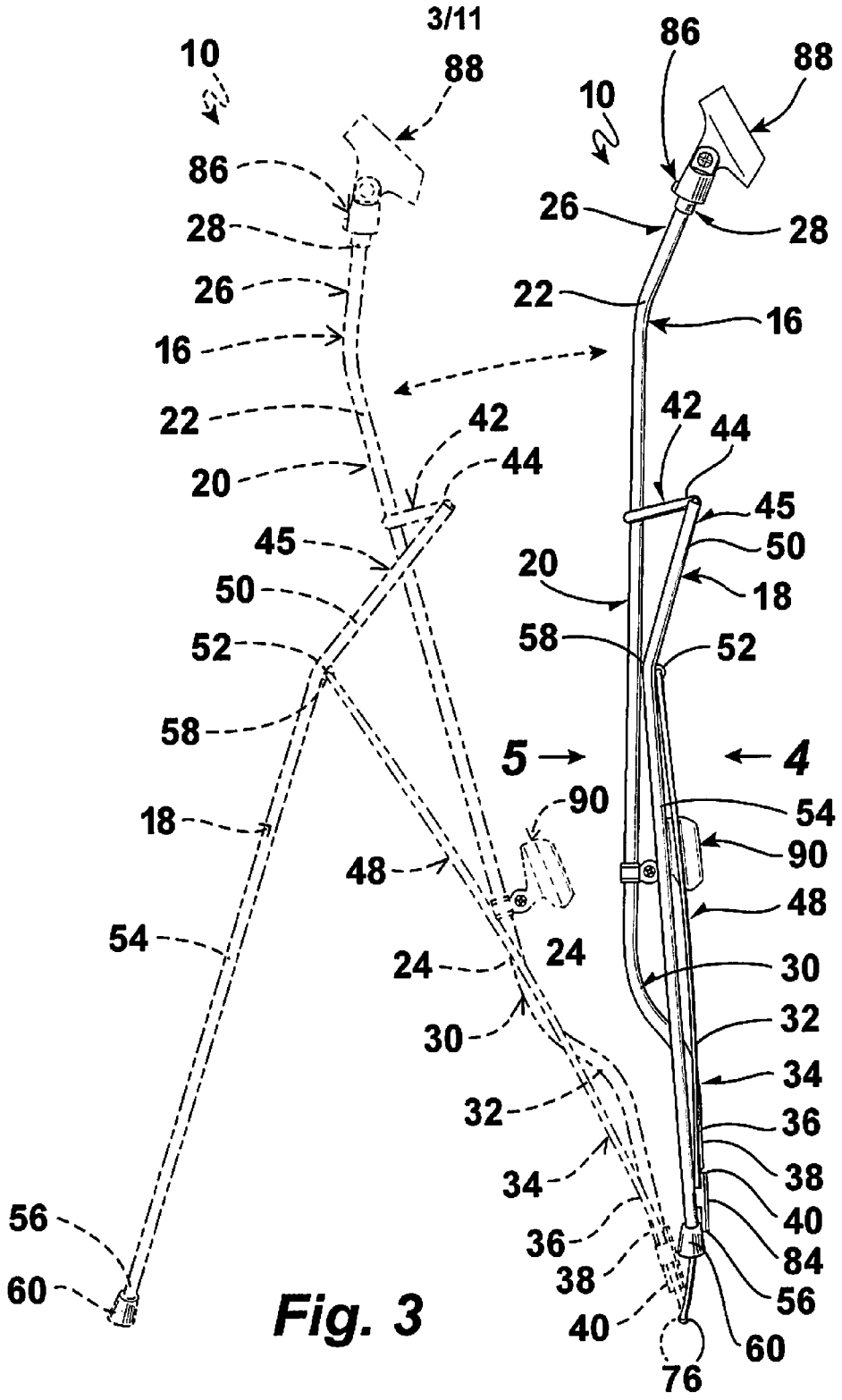
FIG. 3 is a side elevational view of the free standing hose stand shown in solid lines completely collapsed and fully erected in phantom lines.
Figure 4:
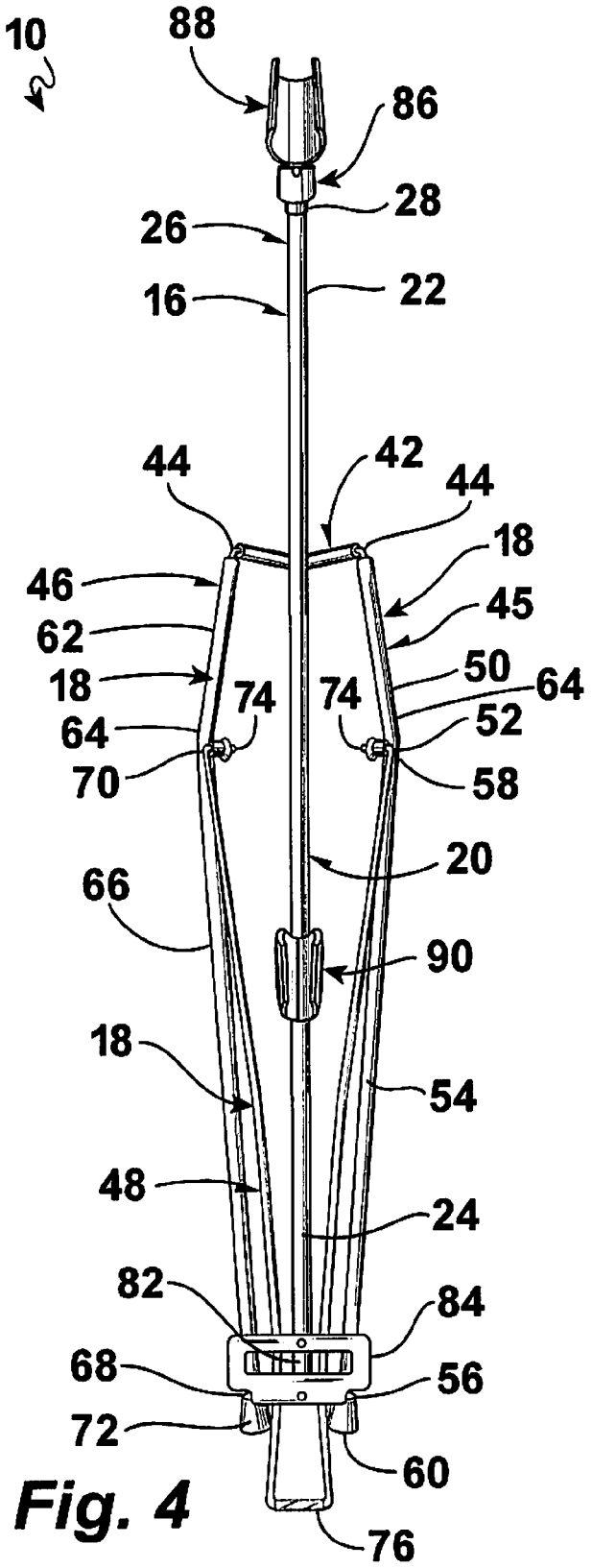
FIG. 4 is a rear elevational view taken in the direction of arrow 4 in FIG. 3.
Figure 5:
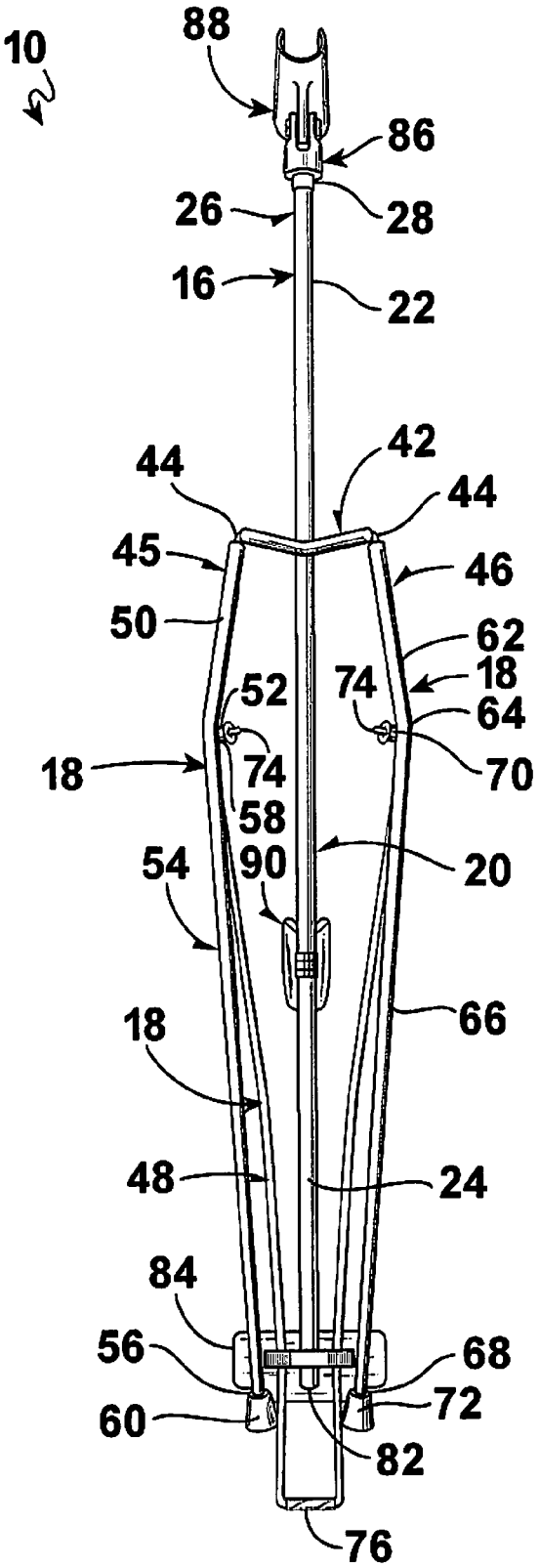
FIG. 5 is a front elevational view taken in the direction of arrow 5 in FIG. 3.
Figure 6:
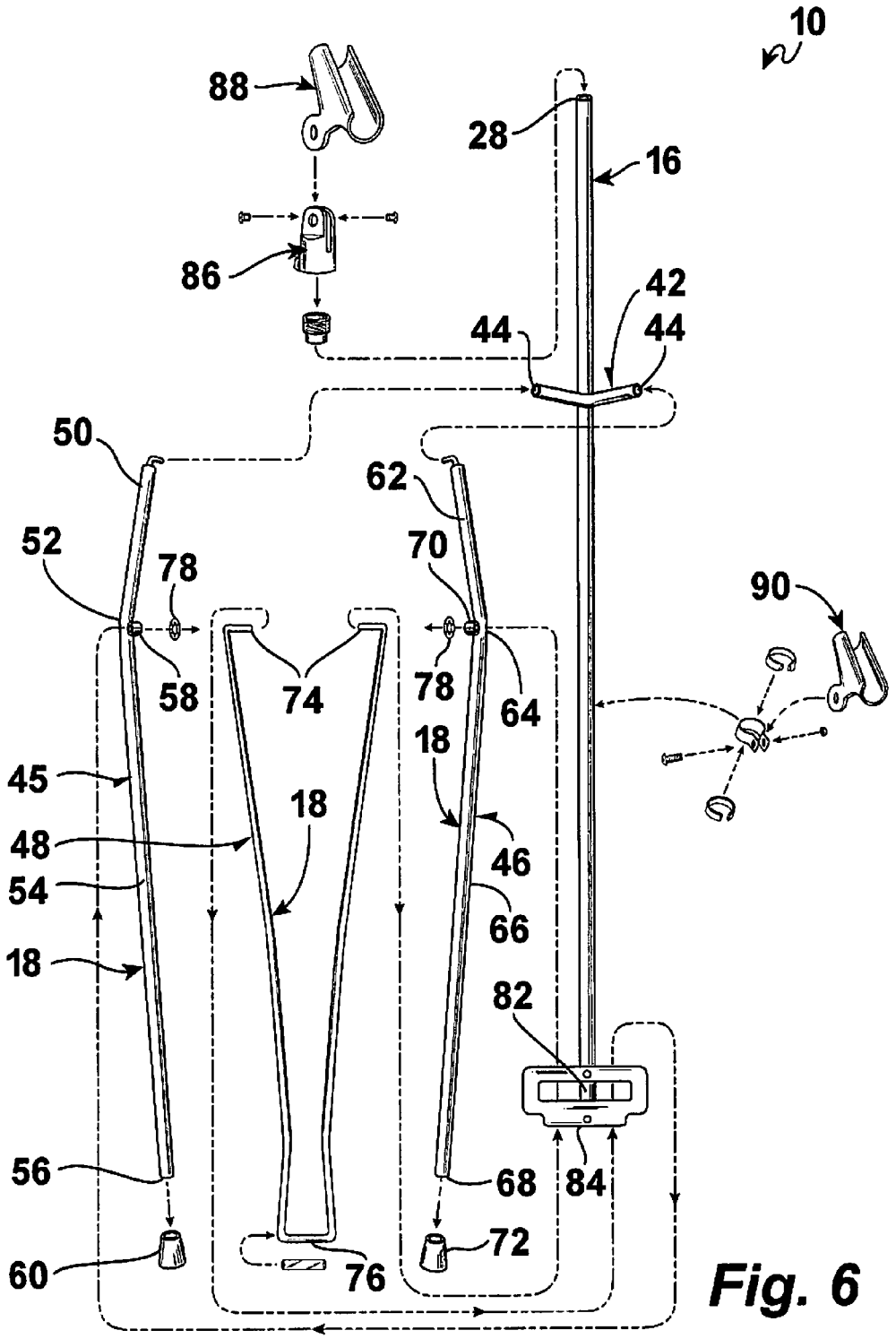
FIG. 6 is a diagrammatic assembly view showing the relationship among all of components of the free standing hose stand while
separated from each other.
Figure 7:
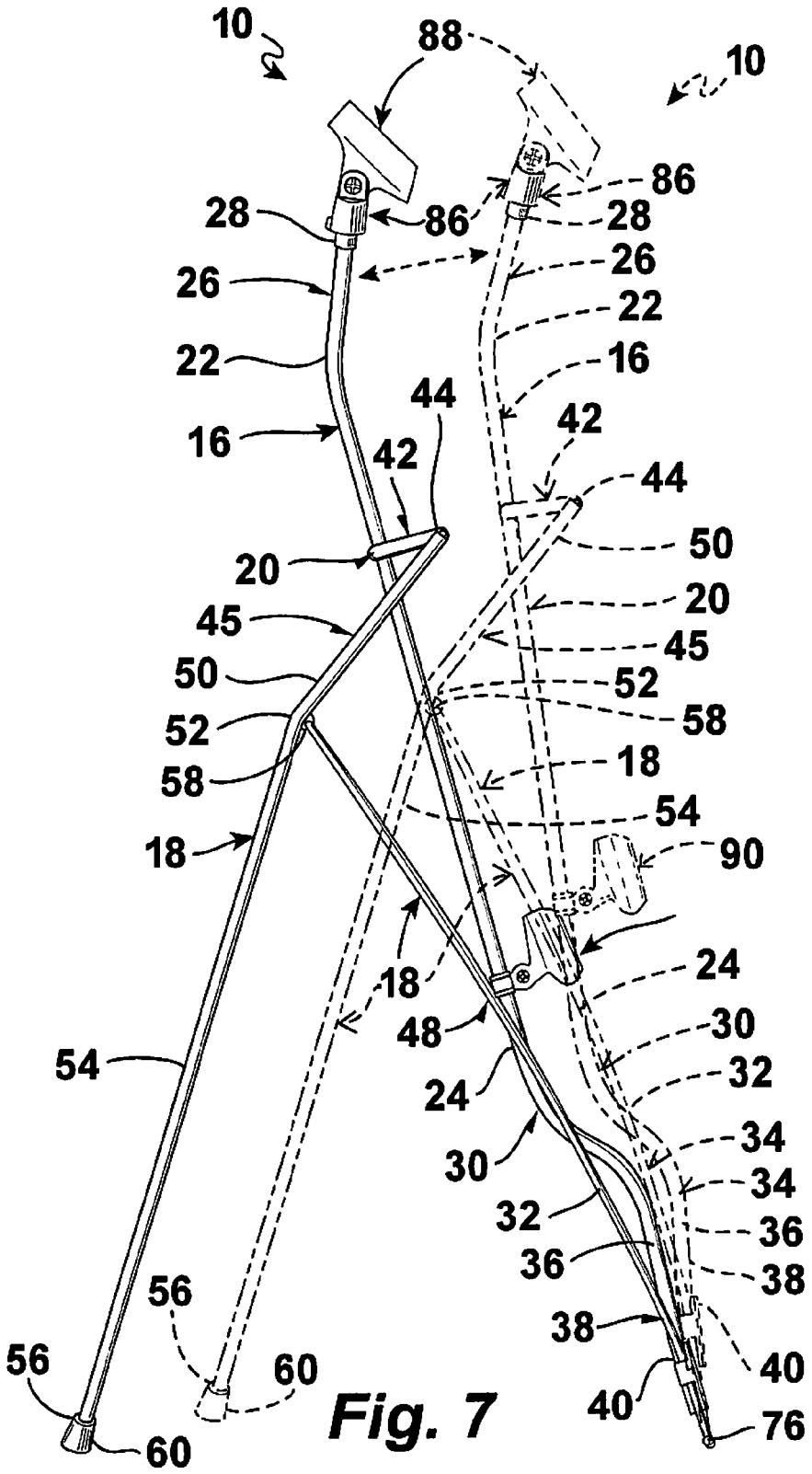
FIG. 7 is another side elevational view of the free standing hose stand shown in solid lines fully erected and partially collapsed and in phantom lines.
Figure 8:
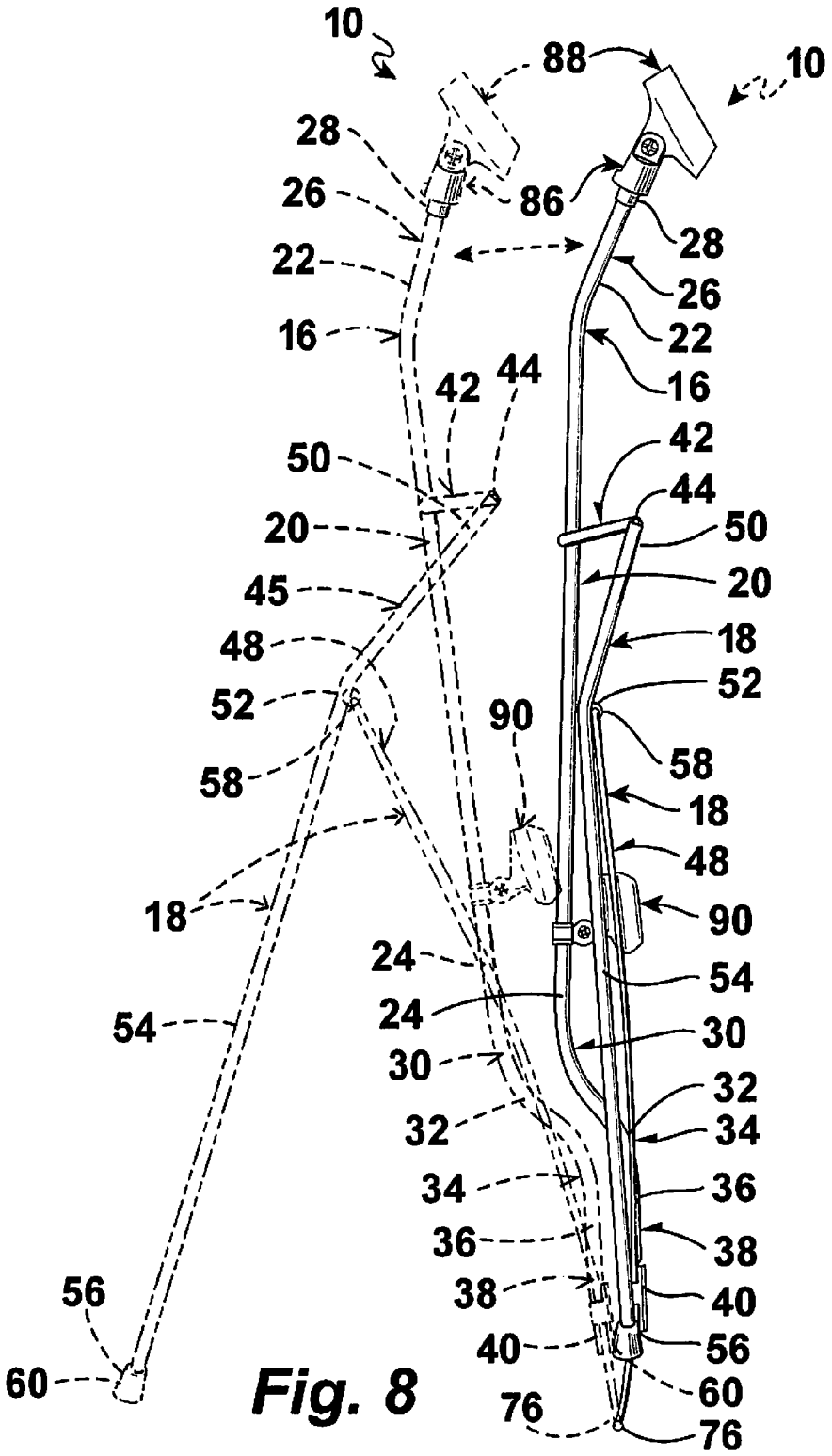
FIG. 8 is still another side elevational view of the free standing hose stand shown in solid lines fully collapsed and partially collapsed and in phantom lines.

Referring now to the figures, in which like numerals indicate like parts, and particularly to FIGS. 1 and 2, the free-standing stand of the embodiments of the present invention is shown generally at 10 for replaceably holding a hose 12 and for automatically erecting upon contact with a supporting surface 14 (FIG. 1) and automatically collapsing when removed from contact with the supporting surface 14 (FIG. 2).

The configuration of the free-standing stand 10 can best be seen in FIGS. 3, 4, 5, 6, 7, and 8, and as such, will be discussed with reference thereto.

The free-standing stand 10 comprises a spine 16 and a tripod 18. The spine 16 is for having the hose 12 be replaceably held thereto. The tripod 18 is operatively connected to the spine 16 in such a matter that when the tripod 18 contacts the supporting surface 14 the tripod 18 automatically erects and when the tripod 18 is removed from contact with the supporting surface 14 the tripod 18 automatically collapses.

The spine 16 is slender, elongated, and made of light weight tubing.

The spine 16 comprises a first portion 20.

The first portion 20 of the spine 16 is straight, slender, elongated, and has an imaginary upper end 22 and an imaginary lower end 24.

The spine 16 further comprises a second portion 26.

The second portion 26 of the spine 16 is straight, slender, elongated, and extends forwardly and straightly from the imaginary upper end 22 of the first portion 20 of the spine 16 to an upper terminal end 28.

The spine 16 further comprises a third portion 30.

The third portion 30 of the spine 16 is arcuate, slender, elongated, and extends concavely forwardly from the imaginary lower end 24 of the first portion 20 of the spine 16 to an imaginary lower end 32.

The spine 16 further comprises a fourth portion 34.

The fourth portion 34 of the spine 16 is arcuate, slender, elongated, and extends convexly forwardly from the imaginary lower end 32 of, and forms a serpentine shape with, the third portion 30 of the spine 16 to an imaginary lower end 36.

The spine 16 further comprises a fifth portion 38.

The fifth portion 38 of the spine 16 is straight, slender, elongated, and extends straightly downwardly from the imaginary lower end 36 of the fourth portion 34 of the spine 16 to a lower terminal end 40.

The spine 16 further comprises a pair of ribs 42.

The pair of ribs 42 of the spine 16 extend perpendicularly forwardly from the spine 16 to form a V-shape in plan view having a pair of terminal ends 44, respectively.

The pair of ribs 42 of the spine 16 are disposed on the first portion 20 of the spine 16.

The tripod 18, by definition, has a first leg 45, a second leg 46, and a third leg 48.

The first leg 45 of the tripod 18 is made of light weight tubing.

The first leg 45 of the tripod 18 has a first portion 50.

The first portion 50 of the first leg 45 of the tripod 18 is straight, slender, elongated, and extends rearwardly downwardly and pivotally from one terminal end 44 of the pair of ribs 42 of the spine 16 to an imaginary lower end 52.

The first leg 45 of the tripod 18 further has a second portion 54.

The second portion 54 of the first leg 45 of the tripod 18 is straight, slender, elongated, and extends rearwardly downwardly from the imaginary lower end 52 of the first portion 50 of the first leg 45 of the tripod 18 to an end 56.

The first leg 45 of the tripod 18 further has an eyelet 58.

The eyelet 58 of the first leg 45 of the tripod 18 is disposed at the imaginary lower end 52 of the first portion 50 of the first leg 45 of the tripod 18.

The first leg 45 of the tripod 18 further has a rubber foot 60.

The rubber foot 60 of the first leg 45 of the tripod 18 is disposed at the end 56 of the second portion 54 of the first leg 45 of the tripod 18.

The second leg 46 of the tripod 18 is a mirror image of said first leg 45 of the tripod 18.

The second leg 46 of the tripod 18 is made of light weight tubing.

The second leg 46 of the tripod 18 has a first portion 62.

The first portion 62 of the second leg 46 of the tripod 18 is straight, slender, elongated, and extends rearwardly downwardly and pivotally from the other terminal end 44 of the pair of ribs 42 of the spine 16 to an imaginary lower end 64.

The second leg 46 of the tripod 18 further has a second portion 66.

The second portion 66 of the second leg 46 of the tripod 18 is straight, slender, elongated, and extends rearwardly downwardly from the imaginary lower end 64 of the first portion 62 of the second leg 46 of the tripod 18 to an end 68.

The second leg 46 of the tripod 18 further has an eyelet 70.

The eyelet 70 of the second leg 46 of the tripod 18 is disposed at the imaginary lower end 64 of the first portion 62 of the second leg 46 of the tripod 18.

The second leg 46 of the tripod 18 further has a rubber foot 72.

The rubber foot 72 of the second leg 46 of the tripod 18 is disposed at the end 68 of the second portion 66 of the second leg 46 of the tripod 18.

The third leg 48 of the tripod 18 is made of spring tension steel.

The third leg 48 of the tripod 18 is generally U-shaped, and as such, has a pair of free ends 74 and a closed portion 76.

The pair of free ends 74 of the third leg 48 of the tripod 18 extend inwardly in opposition to each other.

The third leg 48 of the tripod 18 lies between, and is pivotally attached to, the first leg 45 of the tripod 18 and the second leg 46 of the tripod 18, respectively, and depends therefrom, so as to allow the third leg 48 of the tripod 18 to pivot relative to the first leg 45 of said tripod 18 and said second leg 46 of said tripod 18 and achieve a collapsed mode and an erect mode.

The pair of free ends 74 of the third leg 48 of the tripod 18 are pivotally received in the eyelet 58 of the first leg 45 of the tripod 18 and the eyelet 70 of the second leg 46 of the tripod 18, respectively, and are maintained thereat, by a pair of appropriate fasteners 78, respectively.

The spine 16 further has a lower end 82 and a guide 84.

The guide 84 of the spine 16 is affixed to the lower end 82 of the spine 16.

The closed portion 76 of the third leg 48 of the tripod 18 rides up and down in the guide 84 of the spine 16.

The free-standing stand 10 further comprises a 360° adjustable head 86.

The 360° adjustable head 86 is disposed at the upper terminal end 28 of the second portion 26 of the spine 16.

The free-standing stand 10 further comprises an upper hose holder clip 88. The upper hose holder clip 88 is for replaceably holding a working end of the hose 12.

The upper hose holder clip 88 is pivotally attached to the 360° adjustable head 86, and in combination therewith, provides horizontal and vertical adjusting for the working end of the hose 12.

The free-standing stand 10 further comprises a lower hose holder clip 90. The lower hose holder clip 90 is for replaceably holding another portion of the hose 12.

The lower hose holder clip 90 is pivotally attached to the spine 16 and provides adjusting for the another portion of the hose 12.

Figure 9:
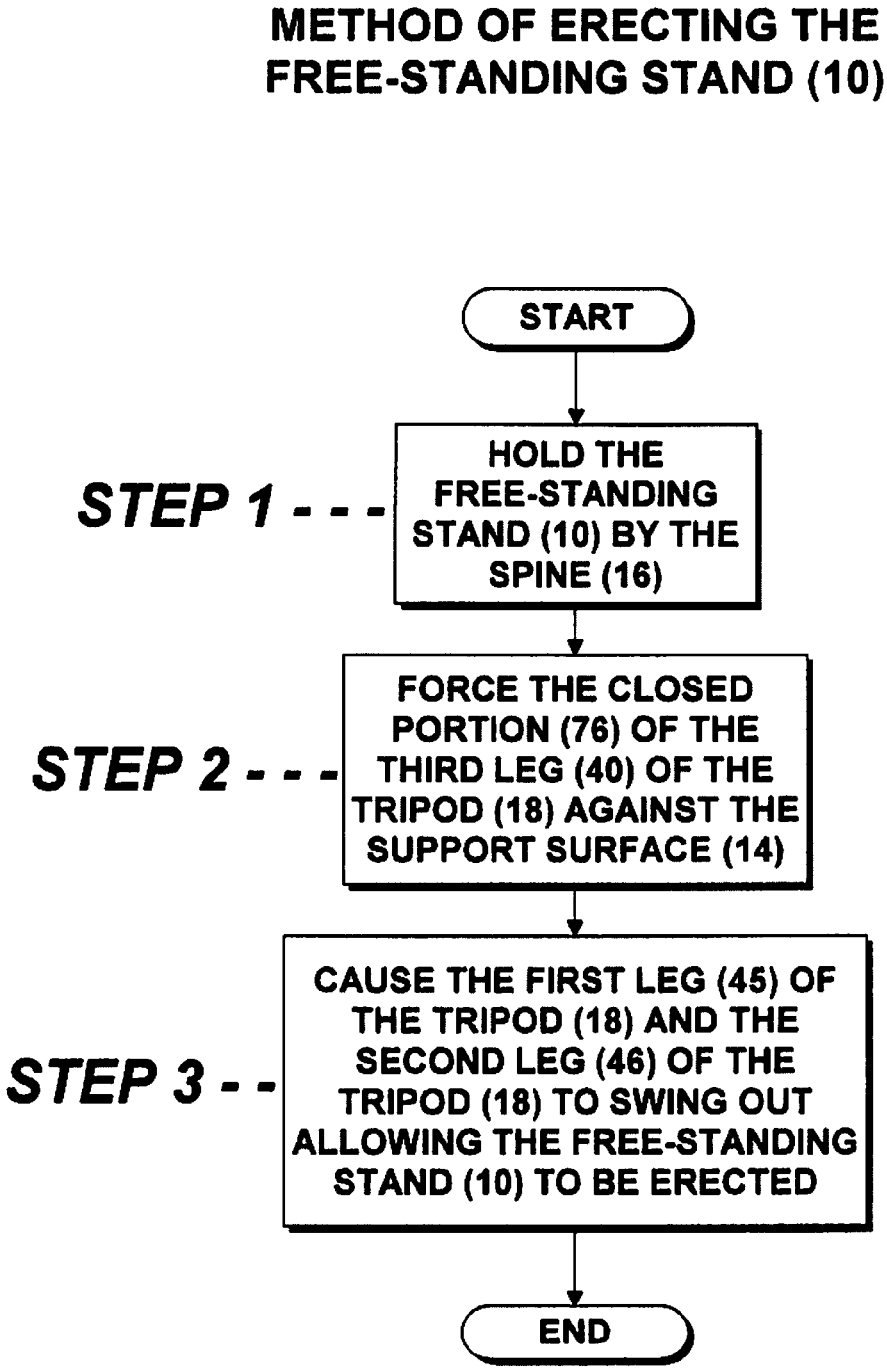
FIG. 9 is a flowchart of the method of erecting the free-standing stand.

The method of erecting and collapsing the free-standing stand 10 can best be seen in FIGS. 9 and 10A-10B, respectively, and as such, will be discussed with reference thereto.

To erect the free-standing device 10:

STEP 1: Hold the free-standing stand 10 by the spine 16;

STEP 2: Force the closed portion 76 of the third leg 48 of the tripod 18 against the supporting surface 14; and STEP 3: Cause the first leg 45 of the tripod 18 and the second leg 46 of the tripod 18 to swing out allowing the free-standing stand 10 to be erected.

To collapse the free-standing device 10:

STEP 1: Grab the free-standing stand 10 by the spine 16;

STEP 2: Lift the spine 16 off of the supporting surface 14;

STEP 3: Cause the closed portion 76 of the third leg 48 to move down the guide 84 of the spine 16; and STEP 4: Cause the first leg 45 of the tripod 18 and the second leg 46 of the tripod 18 to swing closed allowing the free-standing stand 10 to collapse.

It will be understood that each of the elements described above, or two or more together, may also find a useful application in other types of constructions differing from the types described above.

While the invention has been illustrated and described as embodiments of a free standing hose stand, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A free-standing stand for holding a hose and for automatically erecting upon contact with a supporting surface and automatically collapsing when removed from contact with the supporting surface, comprising:

a) a spine; and b) a tripod;

wherein said spine is for having the hose be replaceably held thereto; and wherein said tripod is operatively connected to said spine in such a matter that when said tripod contacts the supporting surface said tripod automatically erects and when said tripod is removed from contact with the supporting surface said tripod automatically collapses;

wherein said spine comprises a first portion;

wherein said first portion of said spine has:

a) an imaginary upper end; and b) an imaginary lower end;

wherein said spine comprises a second portion;

wherein said spine comprises a third portion;

wherein said third portion of said spine is arcuate.

2. The free-standing stand of claim 1, wherein said spine is slender.

3. The free-standing stand of claim 1, wherein said spine is elongated.

4. The free-standing stand of claim 1, wherein said spine is made of light weight tubing.

5. The free-standing stand of claim 1, wherein said first portion of said spine is straight.

6. The free-standing stand of claim 1, wherein said first portion of said spine is slender.

7. The free-standing stand of claim 1, wherein said first portion of said spine is elongated.

8. The free-standing stand of claim 1, wherein said second portion of said spine is straight.

9. The free-standing stand of claim 1, wherein said second portion of said spine is slender.

10. The free-standing stand of claim 1, wherein said second portion of said spine is elongated.

11. The free-standing stand of claim 1, wherein said second portion of said spine extends forwardly and straightly from said imaginary upper end of said first portion of said spine to an upper terminal end.

12. The free-standing stand of claim 11, further comprising a 360° adjustable head.

13. The free-standing stand of claim 12, wherein said 360° adjustable head is disposed at said upper terminal end of said second portion of said spine.

14. The free-standing stand of claim 12, further comprising an upper hose holder clip; and wherein said upper hose holder clip is for replaceably holding a working end of the hose.

15. The free-standing stand of claim 14, wherein said upper hose holder clip is pivotally attached to said 360° adjustable head, and in combination therewith, provides horizontal and vertical adjusting for the working end of the hose.

16. The free-standing stand of claim 14, further comprising a lower hose holder clip; and wherein said lower hose holder clip is for replaceably holding another portion of the hose.

17. The free-standing stand of claim 16, wherein said lower hose holder clip is pivotally attached to said spine and provides adjusting for the another portion of the hose.

18. The free-standing stand of claim 1, wherein said third portion of said spine is slender.

19. The free-standing stand of claim 1, wherein said third portion of said spine is elongated.

20. The free-standing stand of claim 1, wherein said spine comprises a pair of ribs.

21. The free-standing stand of claim 20, wherein said pair of ribs of said spine extend perpendicularly forwardly from said spine to form a V-shape in plan view having a pair of terminal ends, respectively.

22. The free-standing stand of claim 21, wherein said tripod has:

a) a first leg;

b) a second leg; and c) a third leg.

23. The free-standing stand of claim 22, wherein said first leg of said tripod is made of light weight tubing.

24. The free-standing stand of claim 22, wherein said first leg of said tripod has a first portion.

25. The free-standing stand of claim 24, wherein said first portion of said first leg of said tripod is straight.

26. The free-standing stand of claim 24, wherein said first portion of said first leg of said tripod is slender.

27. The free-standing stand of claim 24, wherein said first portion of said first leg of said tripod is elongated.

28. The free-standing stand of claim 24, wherein said first portion of said first leg of said tripod extends rearwardly downwardly and pivotally from one terminal end of said pair of ribs of said spine to an imaginary lower end.

29. The free-standing stand of claim 28, wherein said first leg of said tripod has a second portion.

30. The free-standing stand of claim 28, wherein said first leg of said tripod has an eyelet.

31. The free-standing stand of claim 28, wherein said second leg of said tripod has a first portion.

32. The free-standing stand of claim 29, wherein said second portion of said first leg of said tripod is straight.

33. The free-standing stand of claim 29, wherein said second portion of said first leg of said tripod is slender.

34. The free-standing stand of claim 29, wherein said second portion of said first leg of said tripod is elongated.

35. The free-standing stand of claim 29, wherein said second portion of said first leg of said tripod extends rearwardly downwardly from said imaginary lower end of said first portion of said first leg of said tripod to an end.

36. The free-standing stand of claim 35, wherein said first leg of said tripod has a rubber foot.

37. The free-standing stand of claim 36, wherein said rubber foot of said first leg of said tripod is disposed at said end of said second portion of said first leg of said tripod.

38. The free-standing stand of claim 30, wherein said eyelet of said first leg of said tripod is disposed at said imaginary lower end of said first portion of said first leg of said tripod.

39. The free-standing stand of claim 30, wherein said second leg of said tripod has an eyelet.

40. The free-standing stand of claim 39, wherein said eyelet of said second leg of said tripod is disposed at said imaginary lower end of said first portion of second leg of said tripod.

41. The free-standing stand of claim 39, wherein said third leg of said tripod is generally U-shaped, and as such, has:

a) a pair of free ends; and b) a closed portion.

42. The free-standing stand of claim 41, wherein said pair of free ends of said third leg of said tripod extend inwardly in opposition to each other.

43. The free-standing stand of claim 41, wherein said pair of free ends of said third leg of said tripod are pivotally received in said eyelet of said first leg of said tripod and said eyelet of said second leg of said tripod, respectively, and are maintained thereat, by a pair of appropriate fasteners, respectively.

44. The free-standing stand of claim 41, wherein said spine has:

a) a lower end; and c) a guide.

45. The free-standing stand of claim 44, wherein said guide of said spine is affixed to said lower end of said spine.

46. The free-standing stand of claim 44, wherein said closed portion of said third leg of said tripod rides up and down in said guide of said spine.

47. The free-standing stand of claim 31, wherein said first portion of said second leg of said tripod is straight.

48. The free-standing stand of claim 31, wherein said first portion of said second leg of said tripod is slender.

49. The free-standing stand of claim 31, wherein said first portion of said second leg of said tripod is elongated.

50. The free-standing stand of claim 31, wherein said first portion of said second leg of said tripod extends rearwardly downwardly and pivotally from the other terminal end of said pair of ribs of said spine to an imaginary lower end.

51. The free-standing stand of claim 50, wherein said second leg of said tripod has a second portion.

52. The free-standing stand of claim 51, wherein said second portion of said second leg of said tripod is straight.

53. The free-standing stand of claim 51, wherein said second portion of said second leg of said tripod is slender.

54. The free-standing stand of claim 51, wherein said second portion of said second leg of said tripod is elongated.

55. The free-standing stand of claim 51, wherein said second portion of said second leg of said tripod extends rearwardly downwardly from said imaginary lower end of said first portion of said second leg of said tripod to an end.

56. The free-standing stand of claim 55, wherein said second leg of said tripod has a rubber foot.

57. The free-standing stand of claim 56, wherein said rubber foot of said second leg of said tripod is disposed at said end of said second portion of said second leg of said tripod.

58. The free-standing stand of claim 22, wherein said second leg of said tripod is a mirror image of said first leg of said tripod.

59. The free-standing stand of claim 22, wherein said second leg of said tripod is made of light weight tubing.

60. The free-standing stand of claim 22, wherein said third leg of said tripod is made of spring tension steel.

61. The free-standing stand of claim 22, wherein said third leg of said tripod lies between, and is pivotally attached to, said first leg of said tripod and said second leg of said tripod, respectively, and depends therefrom so as to allow said third leg of said tripod to pivot relative to said first leg of said tripod and said second leg of said tripod and achieve a collapsed mode and an erected mode.

62. The free-standing stand of claim 20, wherein said pair of ribs of said spine are disposed on said first portion of said spine.

63. A free-standing stand for holding a hose and for automatically erecting upon contact with a supporting surface and automatically collapsing when removed from contact with the supporting surface, comprising:

a) a spine; and b) a tripod;

wherein said spine is for having the hose be replaceably held thereto; and wherein said tripod is operatively connected to said spine in such a matter that when said tripod contacts the supporting surface said tripod automatically erects and when said tripod is removed from contact with the supporting surface said tripod automatically collapses;

wherein said spine comprises a first portion;

wherein said first portion of said spine has:

a) an imaginary upper end; and b) an imaginary lower end;

wherein said spine comprises a second portion;

wherein said spine comprises a third portion;

wherein said third portion of said spine extends concavely forwardly from said imaginary lower end of said first portion of said spine to an imaginary lower end.

64. The free-standing stand of claim 63, wherein said spine comprises a fourth portion.

65. The free-standing stand of claim 64, wherein said fourth portion of said spine is arcuate.

66. The free-standing stand of claim 64, wherein said fourth portion of said spine is slender.

67. The free-standing stand of claim 64, wherein said fourth portion of said spine is elongated.

68. The free-standing stand of claim 64, wherein said fourth portion of said spine extends convexly forwardly from said imaginary lower end of said first portion, and forms a serpentine shape with said third portion of said spine to an imaginary lower end.

69. The free-standing stand of claim 68, wherein said spine comprises a fifth portion.

70. The free-standing stand of claim 69, wherein said fifth portion of said spine is straight.

71. The free-standing stand of claim 69, wherein said fifth portion of said spine is slender.

72. The free-standing stand of claim 69, wherein said fifth portion of said spine is elongated.

73. The free-standing stand of claim 69, wherein said fifth portion of said spine extends straightly downwardly from said imaginary lower end of said fourth portion of said spine to a lower terminal end.

* * * * *